US007846044B2

(12) United States Patent
Sagadevan

(10) Patent No.: US 7,846,044 B2
(45) Date of Patent: Dec. 7, 2010

(54) ADJUSTABLE GOLF TEE

(76) Inventor: Suren F. Sagadevan, 729 Manhattan Beach Blvd., #C, Manhattan Beach, CA (US) 90266

( * ) Notice: Subject to any disclaimer, the term of this patent is extended or adjusted under 35 U.S.C. 154(b) by 84 days.

(21) Appl. No.: 12/362,469

(22) Filed: Jan. 29, 2009

(65) Prior Publication Data

US 2009/0137345 A1 May 28, 2009

Related U.S. Application Data

(63) Continuation-in-part of application No. 11/213,462, filed on Aug. 26, 2005, now abandoned.

(51) Int. Cl.
*A63B 69/36* (2006.01)

(52) U.S. Cl. ..... 473/396; 473/401

(58) Field of Classification Search ..... 473/387–403, 473/386; D21/717, 718
See application file for complete search history.

(56) References Cited

U.S. PATENT DOCUMENTS

| | | | | |
|---|---|---|---|---|
| 1,413,496 | A | 4/1922 | Sibbald | 473/398 |
| 1,779,995 | A | 10/1930 | Trane | 473/398 |
| 1,936,625 | A | 11/1933 | Goldman | 473/398 |
| 2,079,387 | A | 5/1937 | Sickmiller | 473/398 |
| 3,406,977 | A | 10/1968 | Voelkerding | 473/398 |
| 3,858,878 | A | 1/1975 | Tassone | 473/398 |
| D306,751 | S | 3/1990 | Orton | D21/717 |
| 5,156,403 | A | 10/1992 | Martino | 473/396 |
| 5,248,144 | A | 9/1993 | Ullerich | 473/279 |
| 6,110,060 | A | 8/2000 | Spoto | 473/396 |
| 6,328,663 | B1 | 12/2001 | Lipstock | 473/396 |
| 2006/0105859 | A1 | 5/2006 | Thirkettle et al. | 473/387 |

*Primary Examiner*—Steven Wong
(74) *Attorney, Agent, or Firm*—John D. Tran; Ardent Law Group

(57) ABSTRACT

An adjustable golf tee with anchoring system that provides a simple adjustable golf tee for use on driving ranges. The general purpose of the present invention is to provide a new and simple adjustable golf tee that can be rotationally adjusted in height and contains a plurality of screw threads that add stability and durability to the golf tee. The inventive device includes an adjustable unit and a base supporting unit which contains a base and a planar bottom surface that can be embedded underneath a commercial mat of a driving range. The adjustable unit and base support unit contains a plurality of screw threads which provides stability, durability and allows for the adjustable unit to be rotationally adjusted in height, while retaining its user customizable height position despite enduring constant and repeated strikes from a typical golf club. The top end of the adjustable unit contains a concave structure to accommodate a golf ball and a lower end having an arrowhead or dome like structure. Optionally, the lower end has a plurality of washers, a circular shock absorber, and a metal ring. The base support unit has a threaded bore, bore, bore walls, a main cylinder, and a planar bottom surface which is preferably circular but can be of any configuration.

8 Claims, 8 Drawing Sheets

ADJUSTABLE GOLF TEE

CROSS-REFERENCE TO RELATED APPLICATIONS

This application claims priority to, and is a Continuation-in-part of, U.S. patent application Ser. No. 11/213,462, filed on Aug. 26, 2005, now abandoned, which is hereby incorporated by reference in it entirety.

Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of all of the prior art of record and any search that the Office deems appropriate.

BACKGROUND OF THE INVENTION

1. Field of the Invention

The present invention relates generally to adjustable golf tee and more specifically it relates to an adjustable golf tee for use on driving ranges. The general purpose of the present invention is to provide a new and simple adjustable golf tee that can be rotationally adjusted in height, containing a plurality of screw threads that add stability and durability to the golf tee.

2. Description of the Related Art

It can be appreciated that adjustable golf tees have been in use for years. Typically, adjustable golf tees are comprised of a two to three components that allow the height of the golf tee to be vertically adjusted by manually raising or lowering the golf tee.

The main problem with conventional adjustable golf tees are that although they allow the golf tee to be adjusted, when constant, repetitive strikes are made to the golf tee by a golf club, the golf tee's height position is often changed or altered. This requires the golf player to readjust the height of the golf tee several times during a normal playing session, thus decreasing the enjoyability and playability of the adjustable golf tee.

While these devices may be suitable for the particular purpose to which they address, they are not as suitable for providing and adjustable golf tee that is stable, durable and the ability for the tee to retain its customizable height position.

In these respects, the adjustable golf tee according to the present invention substantially departs from the conventional concepts and designs of the prior art, and in so doing provides an apparatus primarily developed for the purpose of providing an adjustable golf tee that is stable, durable and allows the height of the golf tee to be rotationally adjusted, which allows the golf tee to retain its user-customizable position.

SUMMARY OF THE INVENTION

In view of the foregoing disadvantages inherent in the known types of adjustable golf tees now present in the prior are, the present invention provides a new and simple adjustable golf tee that can be rotationally adjusted in height, containing a plurality of screw threads that add stability and durability to the golf tee. In addition, the ability of the present invention to be rotationally adjusted in height allows the golf tee to retain its user customizable position despite constant and repeated strikes by a golf club.

The general purpose of the present invention, which will be described subsequently in greater detail, is to provide a new adjustable golf tee for use on driving ranges that has many of the advantages of the adjustable golf tee mentioned heretofore and many novel features that result in a new adjustable golf tee for use on driving ranges which is not anticipated, rendered obvious, suggested, or even implied by any of the prior are adjustable golf tee, either alone or in any combination thereof.

To attain this, the present invention generally comprises an adjustable unit and a base supporting unit which contains a base and a planar bottom surface that can be embedded underneath a commercial mat of a driving range. The adjustable unit and base support unit contains a plurality of screw threads which provides stability, durability and allows for the adjustable unit to be rotationally adjusted in height. The top end of the adjustable unit contains a concave structure to accommodate a golf ball and a lower end having an arrowhead like structure slightly larger than the central aperture of the base support unit. The base support unit comprises of a threaded bore, bore and bore walls. The base consists of a cylindrical support. The planar bottom surface is preferably circular but can be of any configuration and is preferable placed underneath a driving range mat. Thus the present invention provides increased stability, durability and the ability to withstand repeated strikes and impact while retaining its original use customizable height.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of the description and should not be regarded as limiting.

A primary object of the present invention is to provide an adjustable golf tee that will overcome the shortcomings of the prior art devices.

Another object of the present invention is to provide a new and simple adjustable golf tee that can be rotationally adjusted in height and contains a plurality of screw threads that add stability and durability to the golf tee.

Another object is to provide an adjustable golf tee that provides an adjustable golf ball tee which preferably has an adjustable unit and a base support unit that allow the height of the tee to be rotationally adjustable.

Another object is to provide an adjustable golf tee which is stable, durable and is able to endure repeated striking by a golf club, while still retaining its user customizable height.

Another object is to provide an adjustable golf tee that provides an adjustable golf ball tee that can be manufactured at low cost with synthetic material such as rubber or with thermoplastic material, which will endure repeated striking with a golf club.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the face, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
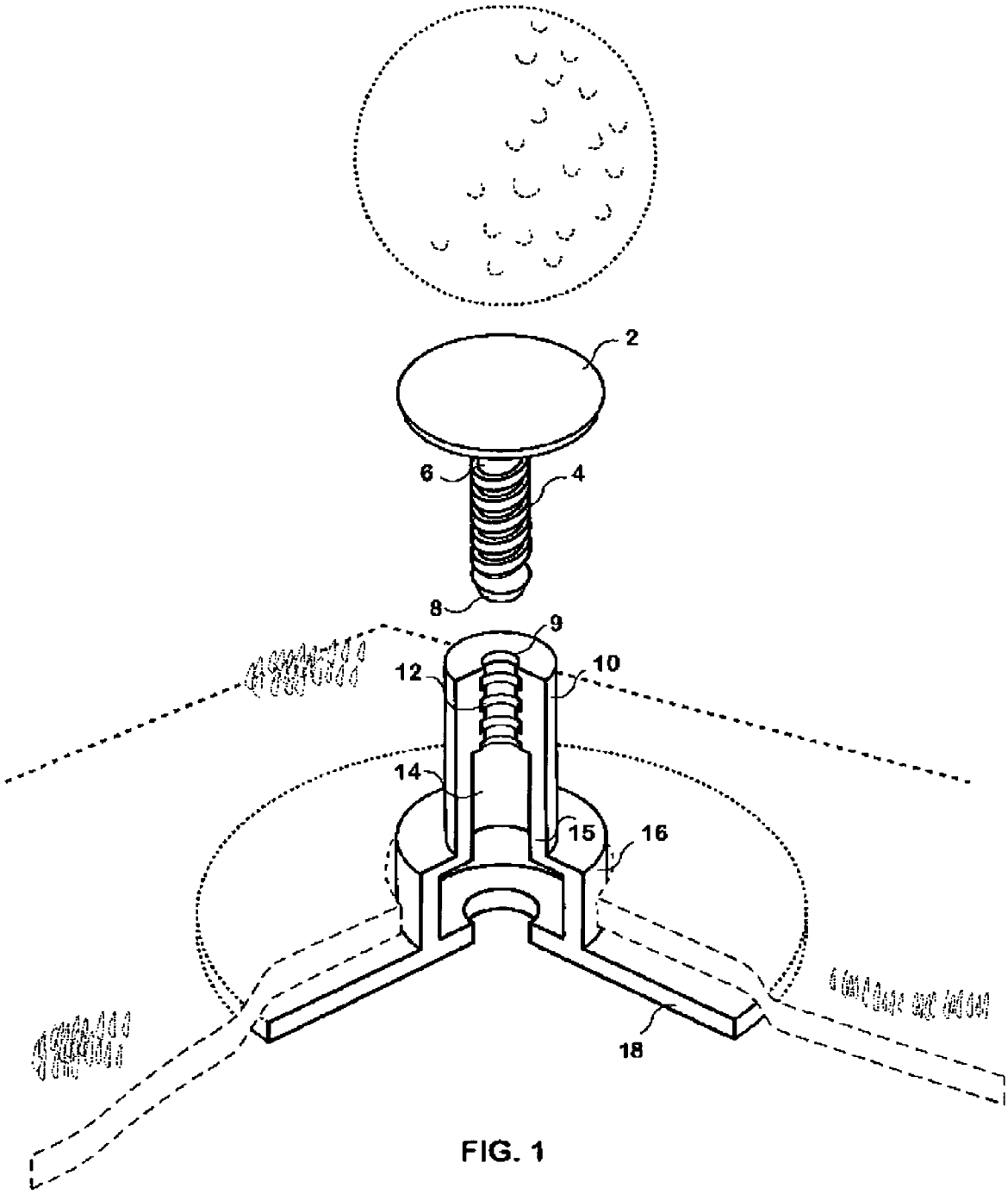
FIG. 1 is a perspective cross-sectional view of the invention.
Figure 2:
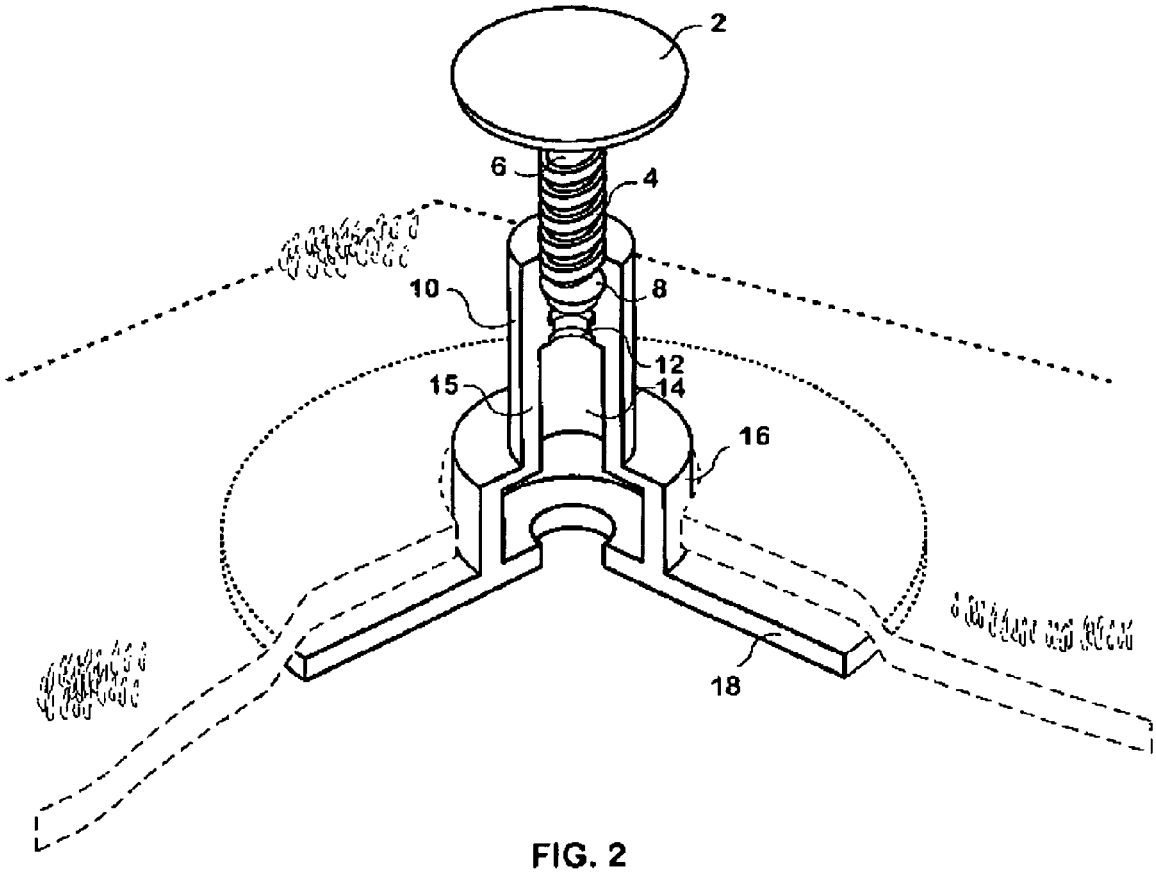
FIG. 2 is a perspective cross-sectional view of the assembled embodiment of the invention.

Turning now descriptively to the drawings, in which similar reference characters denote similar elements throughout the several views, the attached figures illustrate an adjustable golf tee, which comprises an adjustable unit and a base supporting unit which contains a base and a planar bottom surface that can be embedded underneath a commercial mat of a driving range. The adjustable unit and base support unit contain a plurality of screw threads which provides stability, durability and allows for the adjustable unit to be rotationally adjusted in height. The top end of the adjustable unit contains a concave structure to accommodate a golf ball and a lower end having an arrowhead like structure slightly larger than the central aperture of the base support unit. The adjustable unit comprising of a top end that is concaved to accommodate a golf ball, an arrowhead structure on the bottom end, and a plurality of screw threads. The base support unit comprising of a threaded bore, bore, bore walls and a main cylinder. The planar bottom surface is preferably circular but can be of any configuration and is preferable placed underneath a driving range mat. Thus, the present invention provides increased stability, durability and the ability to withstand repeated strikes and impact while retaining its user customizable height.

Figure 3:
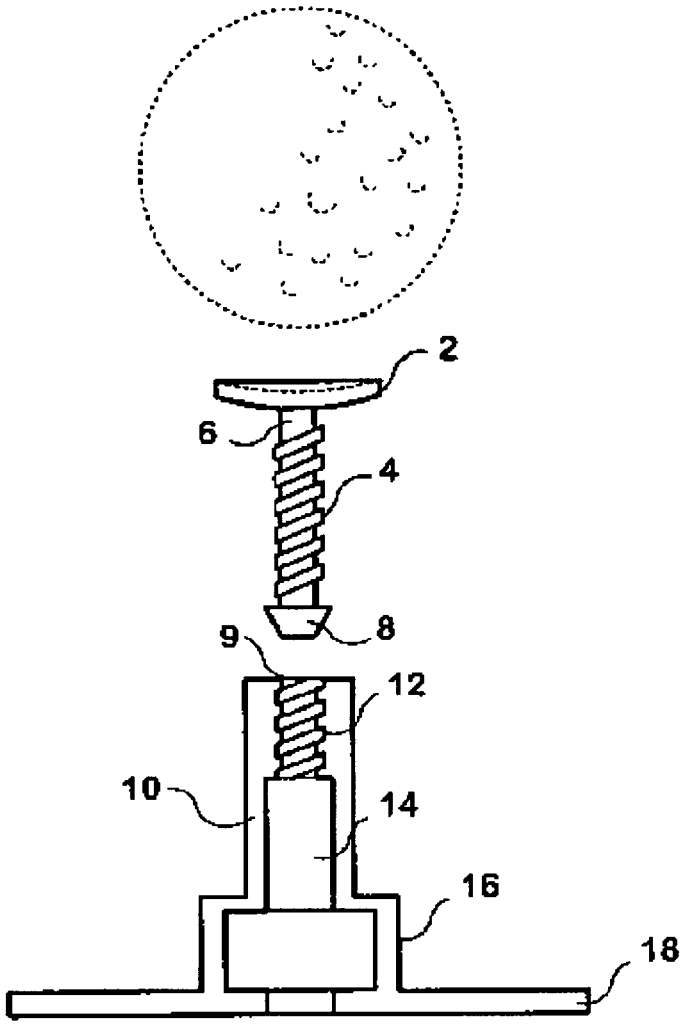
FIG. 3 is a side view of the invention.
Figure 4:
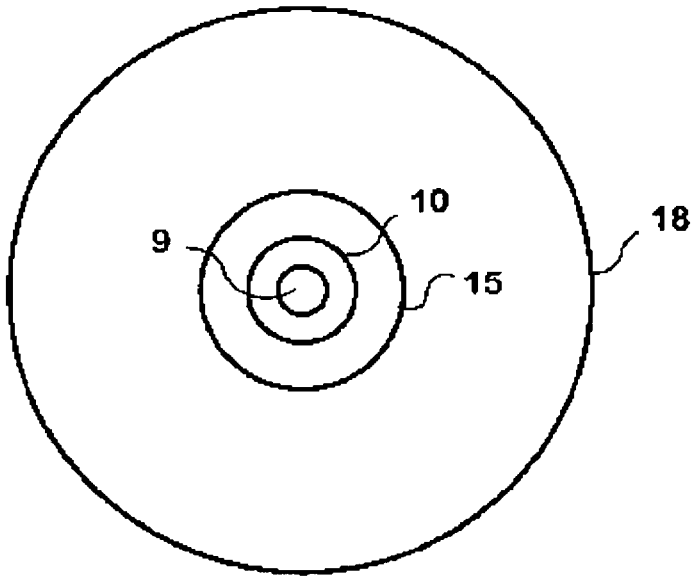
FIG. 4 is a top down perspective view of the invention.
Figure 5:
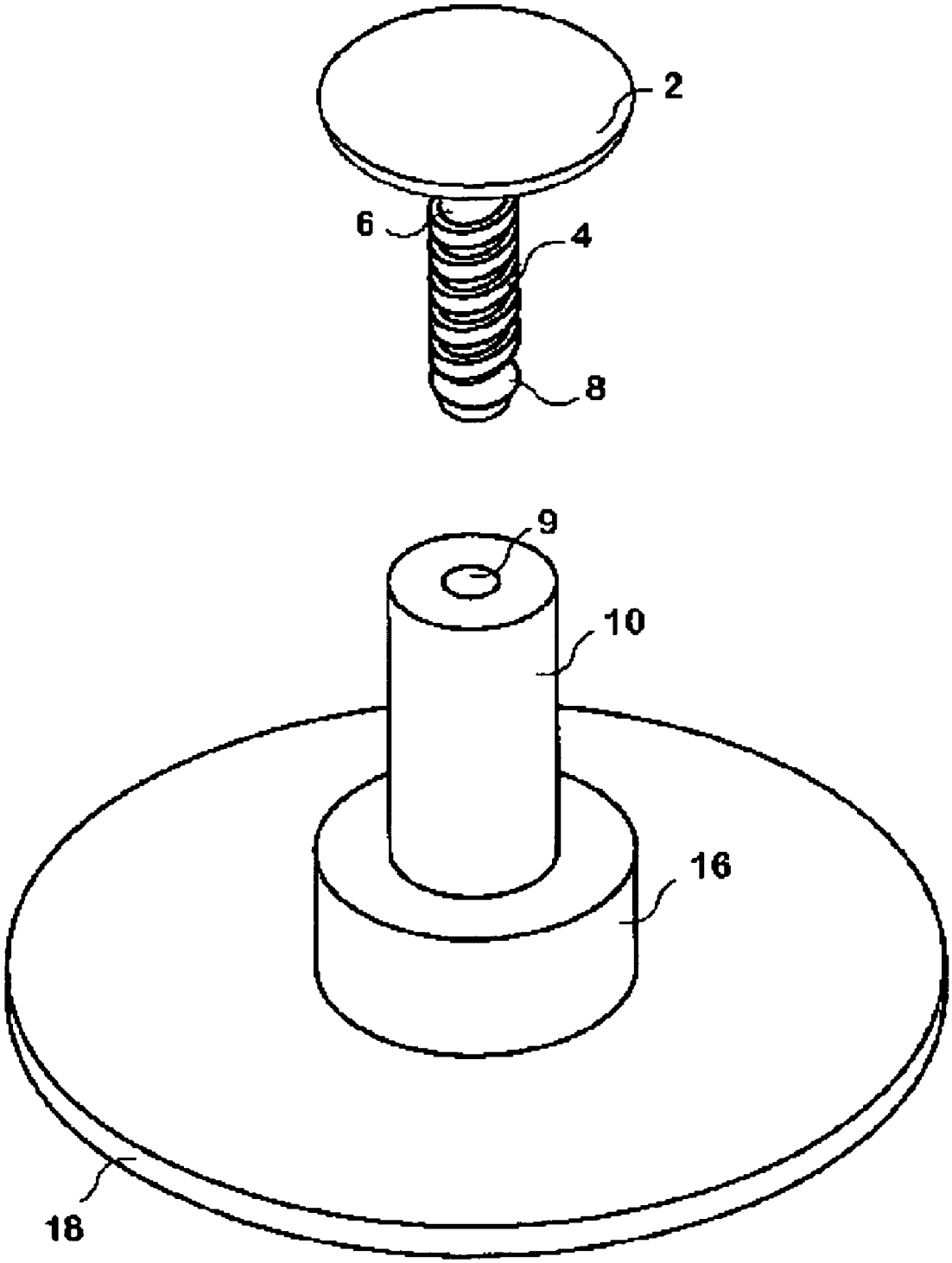
FIG. 5 is a perspective view of the invention.

Turing to the drawings and in particular to FIGS. 1-5 thereof, and adjustable golf ball tee which height can be rotationally adjusted by utilizing an adjustable unit, a base support unit and a planar bottom surface, is described. More specifically in FIG. 1, the adjustable unit 6 comprises a top concave structure 2 to accommodate a golf ball and a bottom arrowhead portion 8 that is slightly larger than the width of the central aperture 9 of the base support unit 10. The adjustable unit 6 contains a plurality of screw threads 4, which is mounted adjustable through the central aperture 9 of the base support unit 10. As seen in FIG. 4, the base support unit 10 contains a threaded bore 12 which accepts and corresponds to the plurality of screw threads 4 on the adjustable unit 6, which allows adjustable unit 4 to be rotationally adjusted in height but at the same time, prevents unwanted movement or deviation from the set desired height position. The base support unit 10 also contains an inner bore 14 and bore walls 15 which is slightly larger width than the central aperture to prevent disassociation of adjustable unit 6 from said base support unit 10. The base 16 in FIG. 3 is preferably circular and provides stability and durability to the base support unit 10. The planar bottom surface 18 is also preferable circular and is preferable placed underneath a driving range mat. Thus the aforementioned golf ball tee is a simple structure and adjustable in height in a rotational manner.

Turning now to FIGS. 6-9, a second embodiment of the invention is disclosed having an anchoring system providing additional durability to the tee. The goal of the anchoring system is to minimize the possibility when the adjustable unit 106 dislodges from the support base unit 110 when the tee experiences a striking force from a golf club.

Figure 6:
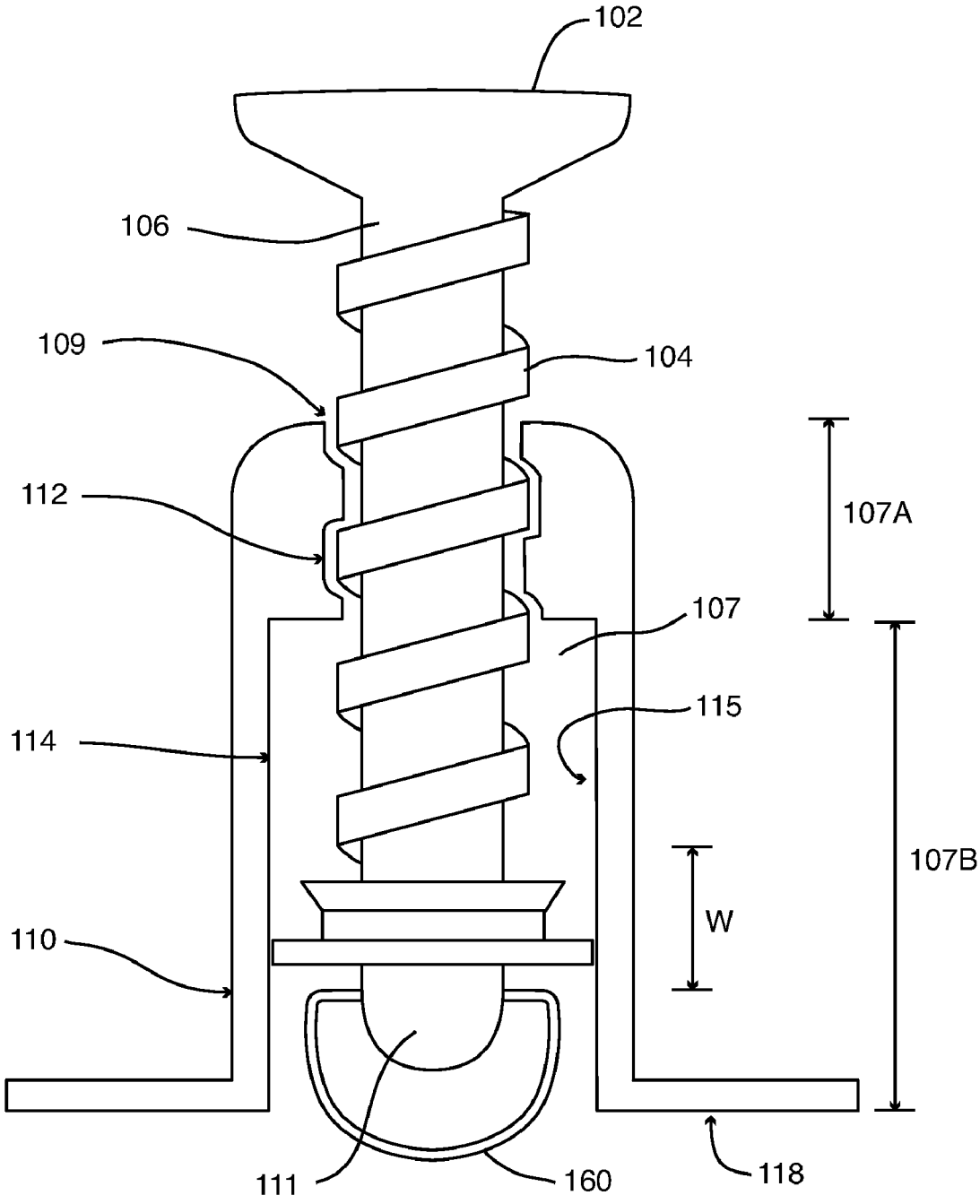
FIG. 6 is a side cross-sectional view of a second embodiment of the invention.
Figure 8:
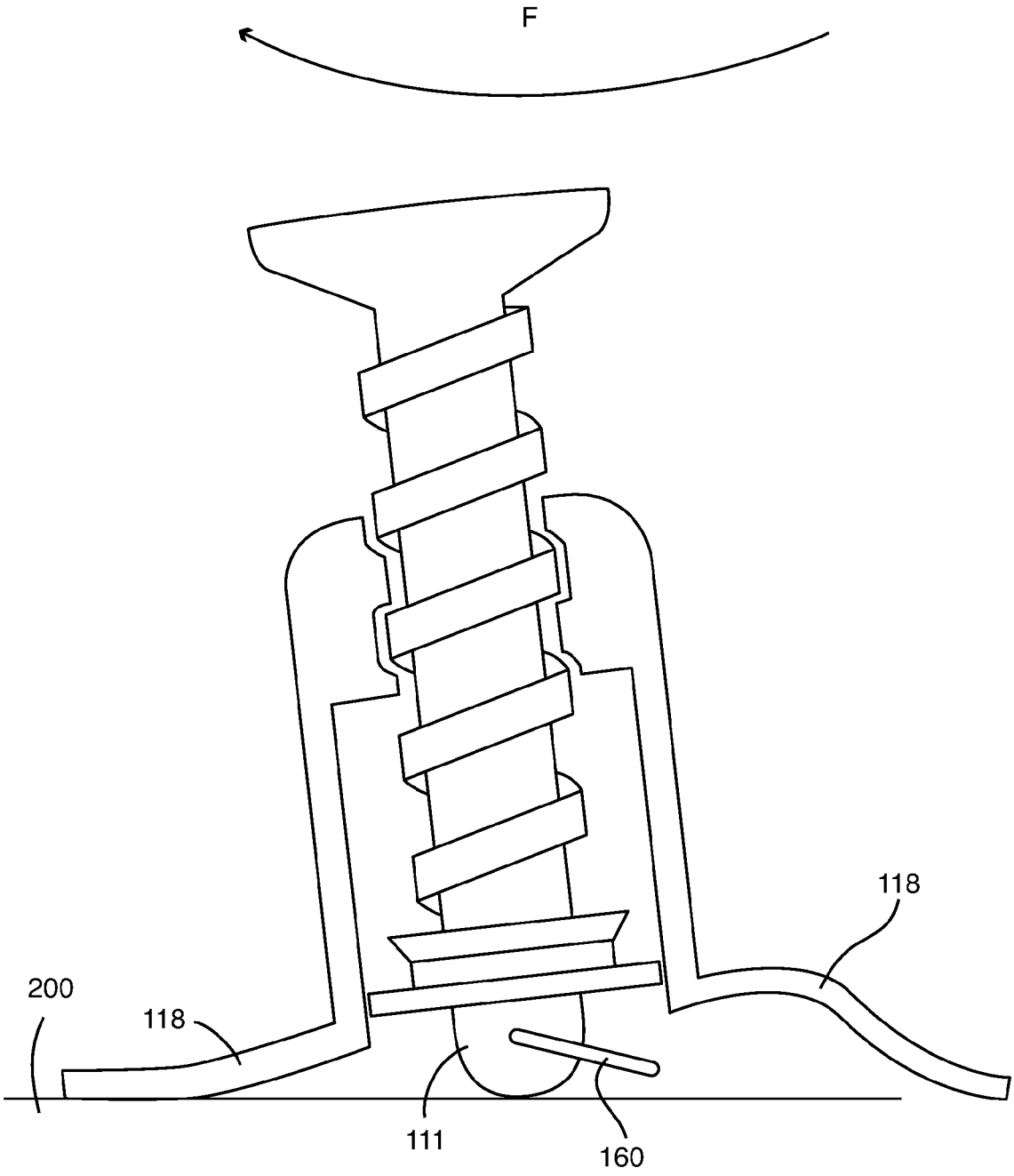
FIG. 8 is a side cross-sectional view of the second embodiment of the invention while a striking force is applied.

In FIG. 6, the tee has a base support unit 110 having an aperture 109 in the center and a central lumen 107. The central lumen is divided into threaded bore portion 107A and unthreaded bore portion 107B. The combined total length of 107A and 107B equals the length of central lumen 107. The unthreaded bore portion 107B of the central lumen 107 in the base support unit 110 has a diameter that is at least 10% larger than a diameter of the adjustable unit 106 such that a wiggle room is allowed for the adjustable unit within the unthreaded bore portion 107. Even more preferably, the unthreaded bore portion 107B of the central lumen 107 in the base support unit 110 has a diameter that is between 5% to 20% larger than a diameter of the adjustable unit 106, such that a wiggle room is allowed for the adjustable unit within the unthreaded bore portion 107. A wiggle room is important because when a striking force F is applied to the tee by a golf club (see FIG. 8), the wiggle room desirably allows the adjustable unit 106 to bend out of shape within the wiggle room as a way of absorbing impact. Additional striking force is then absorbed by the base support unit 110 as it also bends out of shape as shown in FIG. 8.

In one contemplated embodiment, the ratio of the longitudinal length of the threaded bore portion 107A to the unthreaded bore portion 107B is between 1:2.0 and 1:3.0.

In another contemplated embodiment, the ratio of the threaded bore portion 107A to the unthreaded bore portion 107B is between 1:2.0 and 1:2.5.

The adjustable unit 106 is inserted perpendicularly into said aperture 109 of said base support unit 110. The adjustable unit 106 couples to the base support unit 110 and is rotationally adjustable in height to extend beyond said base support unit 110. As illustrated, the adjustable unit 106 has a plurality of screw threads 104. There is a concave structure 102 disposed at the top of said adjustable unit 106 to accommodate a golf ball. Similarly, the base support unit 110 has a plurality of screw threads 112 to cooperate with said plurality of screw threads 104 of said adjustable unit.

It should be noted that the drawing figures are for illustrative purposes only, and do not accurately representation the size and proportion of the parts in the embodiment. For example, in FIGS. 6, 8, and 9, screw threads 104 and 112 are shown with a gap in between. Those skilled in the art will immediately recognize that in reality such gap does not exist.

One skilled in the art will also immediately recognize that the threads 104 and 112 are to make engaging contacts.

The base support unit 110 has a main cylinder (as pointed to by 110 in FIG. 6) and a planar end surface 118 disposed at the bottom end of the main cylinder. In one embodiment, it is crucial that an outer diameter of the main cylinder is smaller than the diameter of the concave structure 102 to provide desired flexibility to the main cylinder. It has been discovered that when the diameter of the main cylinder is bigger than the diameter of the concave structure 102, the base support unit 110 would be undesirably rigid.

In one contemplated embodiment, the base support unit 110 is a single-unit piece to ensure stability, integrity, and desired flexibility or relative rigidity of the base support unit.

Figure 7:
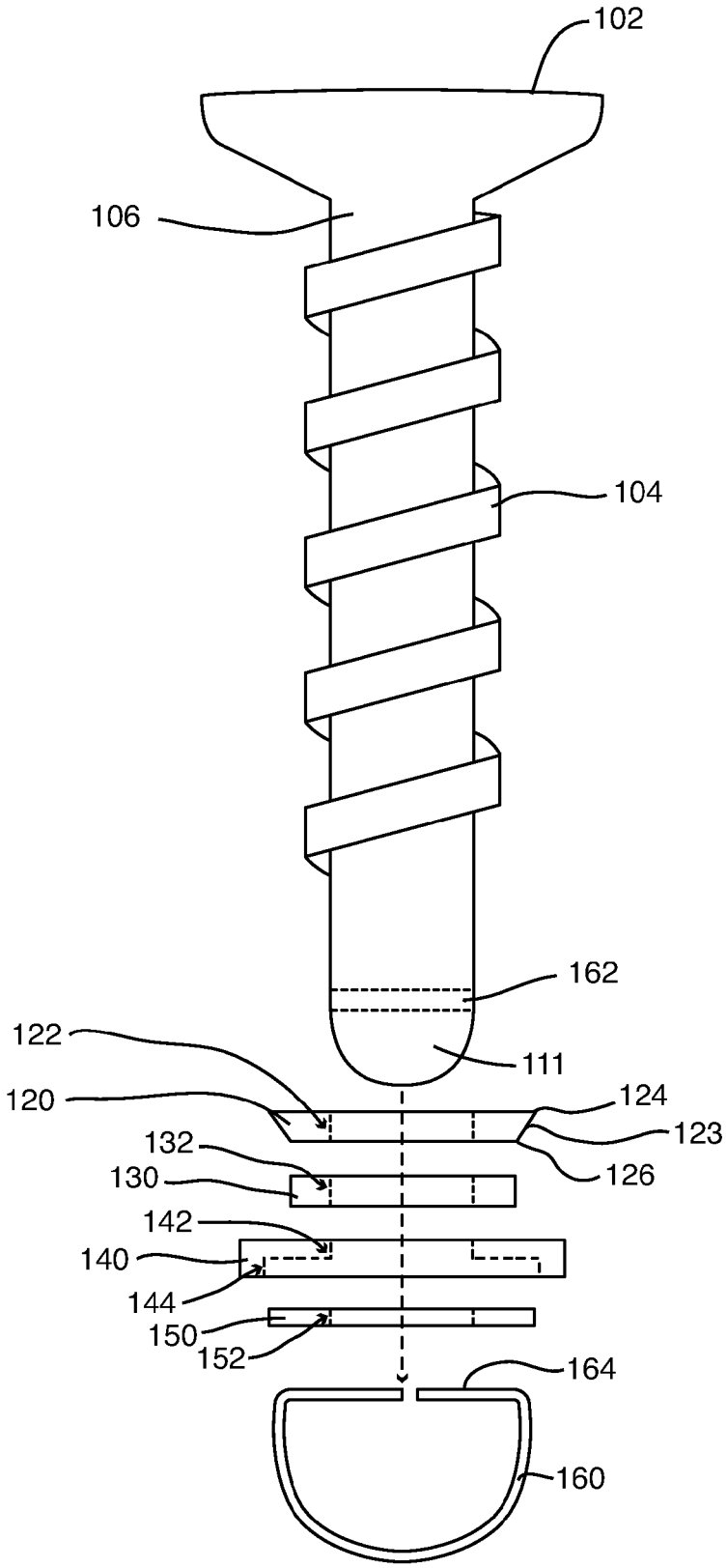
FIG. 7 is an explosive view of the adjustable unit in a second embodiment of the invention.

As for the anchoring system, the adjustable unit is attached with the following parts. Referring now to FIG. 7, a metal ring 160 is attached to a bottom end of said adjustable unit 106 by inserting part of the ring 160 into bore 162. This ring 160 may or may not be tethered to a stationary object to provide additional stability. A metal washer 150 having a central aperture 152 is disposed adjacently above the metal ring at the bottom end 111 of said adjustable unit 106, wherein the bottom end 111 of said adjustable unit 106 is inserted through said central aperture 152 of the metal washer 150.

The anchoring system further contemplates a rubber washer 140 having a central aperture 142 and a washer-receiving seat 144. The rubber washer 140 is disposed adjacently above the metal washer 150 and wherein the washer-receiving seat 144 has a side wall (indicated by arrow 144 in FIG. 7) that is equal to or taller than a thickness of the metal washer 150 such that the seat 144 matingly and completely receives said metal washer 150. In other words, when the rubber washer 140 receives the metal washer 150, the metal washer is flush with the wall of the seat 144. Again, the bottom end 111 of said adjustable unit 106 is inserted through said central aperture 142 of the rubber washer 140.

The anchoring system further contemplates a circular shock absorber 130 having a central aperture 132 disposed adjacently above the rubber washer 140 to absorb a force exerted onto the adjustable unit. The bottom end 111 of said adjustable unit 106 is inserted through said central aperture 132 of the circular shock absorber 130.

As contemplated, the circular shock absorber 130 is made of material that is at least 10% more resilient than a material of the angled washer; more preferably, at least 20% more; even more preferably, at least 25% more resilient.

Optionally, the circular shock absorber 130 is made of material that is at least 30% more resilient than a material of the angled washer 120.

The anchoring system further contemplates an angled washer 120 having a central aperture 122 and a beveled circumferential wall 123. The angled washer 120 is disposed adjacently above the circular shock absorber 130, wherein the bottom end 111 of said adjustable unit 106 is inserted through said central aperture 122 of the angled washer 120.

In one embodiment, the beveled circumferential wall 123 has a smaller circumference edge 126 disposed below a larger circumference edge 124, and the larger circumference edge 124 defines a circular plane having a diameter larger than a diameter of the aperture 109 of the base support unit.

Optionally, the adjustable unit 106 has a dome (also marked as 111) disposed at a distal end of the bottom end 111 of said adjustable unit. Purpose of this dome 111 will become more apparent in FIG. 8. In FIG. 8, the metal ring 160 is pivoted to the side, as it is normally freely pivotable. As illustrated in FIG. 8, the adjustable unit 106 is adjustable by a user to a level where the bottom end 111 is close to or is touching the ground 200. Here, a striking force F by a golf club is shown by arrow F; the tee temporarily misshapes and tilts to the left. Most notably, the base support unit 110 absorbs some of the impact and changes shapes due to its flexible nature. The dome 111 minimizes resistance of such tilting, because its rounded surface allows tilting to take place. In other words, tilting is effectuated by having a pivot point that is at the center of the adjustable unit 106 (or the most distal tip of the dome 111). Comparing such the dome 111 to a flat end design (not shown); a flat end will cause a tilting by having a pivot point at the edge of the adjustable unit 106. Tilting by having a pivot point at the edge of the adjustable unit 106 is less preferred, because it tends to push the adjustable unit 106 slightly upwards, causing inaccuracy as a result of minute unwanted upward force to the golf ball.

Referring back to FIG. 6, a wiggle distance W is allowed where the angled washer 120, the shock absorber 130, the rubber washer 140, and the metal washer 150, may freely move about up and down in a direction parallel to the central axis of the adjustable unit 106. Of course, such wiggle distance W only allows free wiggle room only when the adjustable unit 106 is not in it uppermost position.

Figure 9:
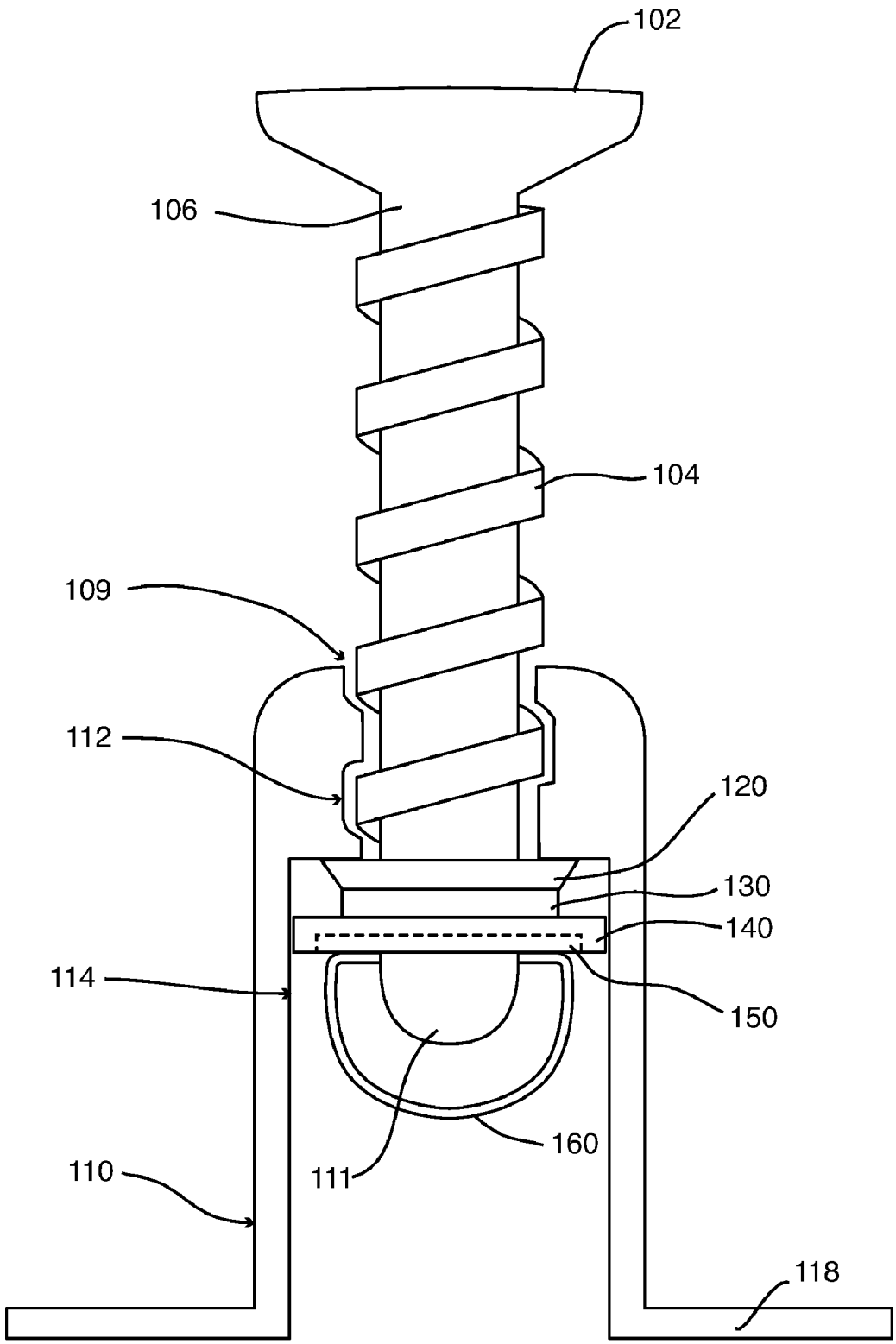
FIG. 9 is a side cross-sectional view of the second embodiment of the invention with the adjustable unit adjusted to the very top.

In operation, when the club strikes the tee, a pull on the tee is created causing the adjustable unit 10 to move upwards. The treads 104 and 112 are contemplated to withstand such force and keep the adjustable unit 106 in place. In FIG. 9, when a user prefers a taller tee, the adjustable unit 106 is rotated to its highest position as shown in FIG. 9. When a pull force is created, the angled washer abuts against the treaded bore 107A and prevents the adjustable unit 106 from dislodging from the base support unit 110. Circular shock absorber 130 acts to absorb some of the impact of the pull force, and offset the pulling effect. The metal ring 160 abuts against the metal washer 150, making dislodging even more difficult.

The metal washer 150 is encapsulated in rubber washer 140, so as to prohibit the metal ring 150 from slipping through the shock absorber 130 and the angled washer 120. The combination of metal ring 160, metal washer 150, and rubber washer 140 securely fastens the rest of the anchoring system (e.g., angled washer and shock absorber) to the adjustable unit 106.

A typical use of the present embodiment of the invention involves the golf player at a driving range that desires to adjust the height of the golf tee to a favorable height to enhance the player's enjoyability and comfortableness. In typical use, the golf player will grab the adjustable unit and rotate it in either a clockwise manner or a counter clock wise manner which will raise or lower the adjustable golf tee. The Golf player will generally place the ball on the tope end of the adjustable unit which contains a concave top which accommodates a golf ball.

As to a further discussion of the manner of usage and operation of the present invention, the same should be apparent from the above description. Accordingly, no further discussion relating to the manner of usage and operation will be provided.

With respect to the above description the, it is to be realized that the optimum dimensional relationships for the part of the invention, to include variations in size, materials, shape, form, function and manner of operation, assembly and use, are deemed readily apparent and obvious to one skilled in the are, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustable golf ball tee, comprising:

a) a base support unit having an aperture in the center and a central lumen; wherein the central lumen is divided into threaded bore portion and unthreaded bore portion;

b) an adjustable unit inserted perpendicularly into said aperture of said base support unit;

c) said adjustable unit being coupled to said base support unit and is rotationally adjustable in height to extend beyond said base support unit;

d) said adjustable unit having a plurality of screw threads;

e) a concave structure disposed at the top of said adjustable unit to accommodate a golf ball;

f) said base support unit containing a plurality of screw threads;

g) said base support unit containing a planar end surface;

h) said plurality of screw threads of said adjustable unit cooperate with said plurality of screw threads of said base support unit;

i) a metal ring attached to a bottom end of said adjustable unit;

j) a metal washer having a central aperture disposed adjacently above the metal ring at the bottom end of said adjustable unit, wherein the bottom end of said adjustable unit is inserted through said central aperture of the metal washer;

k) a rubber washer having a central aperture and a washer-receiving seat, said rubber washer is disposed adjacently above the metal washer and wherein the washer-receiving seat has a side wall that is equal to or taller than a thickness of the metal washer such that the seat matingly and completely receives said metal washer, and wherein the bottom end of said adjustable unit is inserted through said central aperture of the rubber washer; and l) a circular shock absorber having a central aperture disposed adjacently above the rubber washer to absorb a force exerted onto the adjustable unit, wherein the bottom end of said adjustable unit is inserted through said central aperture of the circular shock absorber.

2. The adjustable golf tee of claim 1 further comprising an angled washer having a central aperture and a beveled circumferential wall, wherein the angled washer is disposed adjacently above the circular shock absorber, wherein the bottom end of said adjustable unit is inserted through said central aperture of the angled washer.

3. The adjustable golf tee of claim 2, wherein the beveled circumferential wall has a smaller circumference edge disposed below a larger circumference edge, and wherein the larger circumference edge defines a circular plane having a diameter larger than a diameter of the aperture of the base support unit.

4. The adjustable golf tee of claim 3 further comprising a dome disposed at a distal end of the bottom end of said adjustable unit, and wherein the unthreaded bore portion of the central lumen in the base support unit has a diameter that is at least 10% larger than a diameter of the adjustable unit such that a wiggle room is allowed for the adjustable unit within the unthreaded bore portion.

5. The adjustable golf tee of claim 3, wherein the circular shock absorber is made of material that is at least 10% more resilient than a material of the angled washer.

6. The adjustable golf tee of claim 5, wherein the circular shock absorber is made of material that is at least 30% more resilient than a material of the angled washer.

7. The adjustable golf tee in claim 6, wherein said end surface is adapted to lay underneath a commercial mat.

8. An adjustable golf ball tee, consisting of:

a base support unit having an aperture in the center and said base support unit containing a plurality of screw threads within a central lumen;

an adjustable unit inserted perpendicularly into said aperture of said base support unit;

said adjustable unit being rotationally adjustable in height to extend beyond said base support unit;

said adjustable unit having a plurality of screw threads;

a concave structure having a diameter at the top of said adjustable unit to accommodate a golf ball;

a dome distal end disposed on the bottom end of the adjustable unit;

a metal ring attached to the bottom end of said adjustable unit;

a metal washer having a central aperture disposed adjacently above the metal ring;

a rubber washer having a central aperture and a washer-receiving seat, said rubber washer is disposed adjacently above the metal washer;

a circular shock absorber having a central aperture disposed adjacently above the rubber washer to absorb a force exerted onto the adjustable unit, wherein the bottom end of said adjustable unit is inserted through said central aperture of the circular shock absorber; and an angled washer disposed adjacently above the circular shock absorber.

* * * * *